US006393785B1

(12) United States Patent
Burt

(10) Patent No.: US 6,393,785 B1
(45) Date of Patent: May 28, 2002

(54) WATER DRAINAGE SYSTEM FOR A DECK

(75) Inventor: Kevin T. Burt, Columbus, OH (US)

(73) Assignee: Crane Products Ltd., Columbus, OH (US)

( * ) Notice: Subject to any disclaimer, the term of this patent is extended or adjusted under 35 U.S.C. 154(b) by 0 days.

(21) Appl. No.: 09/564,511

(22) Filed: May 4, 2000

(51) Int. Cl.[7] ..... E04F 17/04

(52) U.S. Cl. ..... 52/302.3; 52/302.1; 52/11; 52/15; 52/461; 52/478; 52/715

(58) Field of Search ..... 52/11–15, 127.5, 52/302.1, 302.3, 462, 478, 302.4, 650.3, 302.5, 712, 715, 464, 461; 405/119

(56) References Cited

U.S. PATENT DOCUMENTS

| | | | | |
|---|---|---|---|---|
| 4,065,883 A | | 1/1978 | Thibodeau | |
| 4,663,894 A | | 5/1987 | LaRoche et al. | |
| 4,787,773 A | | 11/1988 | Kehler | |
| 4,860,502 A | | 8/1989 | Mickelsen | |
| 5,195,281 A | | 3/1993 | Kosko | |
| 5,511,351 A | | 4/1996 | Moore | |
| 5,758,467 A | | 6/1998 | Snear et al. | |
| 5,765,328 A | | 6/1998 | Moore | 52/302.1 |
| 6,164,019 A | * | 12/2000 | Salley | 52/11 |
| 6,212,837 B1 | * | 4/2001 | Davis et al. | 52/302.1 |

* cited by examiner

*Primary Examiner*—Carl D. Friedman
*Assistant Examiner*—Yvonne M. Horton
(74) *Attorney, Agent, or Firm*—Standley & Gilcrest LLP

(57) ABSTRACT

A drainage system that is adapted to be installed between two supports. The supports may be the joists of an outdoor deck. The drainage system comprises a drainage panel and two clips. The drainage panel is comprised of a first end portion and a second end portion. A first clip is adapted to be secured to one of the supports. The first clip has a base and two flanges. The flanges extend from the base such that they converge and engage the first end portion of the drainage panel. The second clip is adapted to be secured to the other support. The second clip also has a base and two flanges. The flanges extend from the base and converge. The second end portion of the drainage panel is engaged by the flanges of the second clip.

20 Claims, 4 Drawing Sheets

WATER DRAINAGE SYSTEM FOR A DECK

BACKGROUND AND SUMMARY OF THE INVENTION

The present invention relates generally to decks and, more particularly, to a water drainage system for a deck.

Many homes today include an outdoor deck. An outdoor deck is typically made of wood, although it can also be made of a wood replacement material such as TIMBERTECH® or another cellulosic/thermoplastic composite material. It is generally comprised of a series of deck boards that are supported by deck joists. The deck joists are typically 2×6's or 2×8's laid on their sides. The deck boards typically rest on the tops of the deck joists, and there are gaps between adjacent deck boards to allow the water to flow through the deck so that it does not accumulate on the deck surface.

The area beneath an outdoor deck may be finished or unfinished. For example, the area beneath an outdoor deck may be a patio, a storage area, a screened porch, or the like. Conversely, the area beneath an outdoor deck may simply be natural ground.

Water passing through the gaps in the deck boards can present several problems. For example, if the area beneath the outdoor deck is finished, the water may damage furniture, electronics, or other items located or stored beneath the deck. It will also discourage people from seeking shelter under the deck. On the other hand, the water may cause erosion or the growth of unwanted grass, weeds, and other vegetation under the deck if the area is unfinished.

In light of the aforementioned problems, a need exists for an improved water drainage system that increases the usable space beneath a deck. Another need exists for an improved water drainage system that limits mildew and other types of water damage to the area and items beneath a deck. A need also exists for an improved water drainage system for a deck that is durable and water-resistant. Still another need exists for an improved water drainage system that limits erosion and the growth of unwanted vegetation beneath a deck. Yet another need exists for an improved water drainage system that is easy to install and relatively maintenance free. Finally, a need exists for an improved water drainage system that can be installed on a new or existing deck.

The present invention satisfies some or all of the aforementioned needs. One embodiment of the present invention is a drainage system that is adapted to be installed between two supports. The supports may be the joists of an outdoor deck. The drainage system comprises a drainage panel and two clips. The drainage panel is comprised of a first end portion and a second end portion. A first clip is adapted to be secured to one of the supports. The first clip has a base and two flanges. The flanges extend from the base such that they converge and engage the first end portion of the drainage panel. The second clip is adapted to be secured to the other support. The second clip also has a base and two flanges. The flanges extend from the base and converge. The second end portion of the drainage panel is engaged by the flanges of the second clip.

It is preferred that the end portions of the drainage panel are substantially straight. It is further preferred that the drainage panel is generally V-shaped or generally U-shaped.

The first clip and the second clip are preferably substantially identical and generally F-shaped. Each of the clips may be adapted to be secured to a deck joist or another type of support by at least one nail. With regard to each of the clips, one flange may be disposed substantially above the other flange, and the upper flange may be longer than the lower flange. In addition, each of the flanges may be substantially straight.

Another embodiment of the drainage system also comprises a drainage panel and two clips. In this embodiment, the drainage panel is comprised of a first end portion and a second end portion. A first clip is adapted to be secured to a first support. The first clip has a base and two flanges. The flanges extend from the base, and each of the flanges has a tip. The first end portion of the drainage panel is held only by the tips of the first clip. The second clip is adapted to be secured to a second support. The second clip also has a base and two flanges. The flanges extend from the base. The second end portion of the drainage panel is held only by the tips of the flanges of the second clip. This embodiment may include the optional and preferred features of the previous embodiment.

The present invention includes another embodiment of a drainage system. This drainage system also comprises a drainage panel and two clips. The drainage panel is comprised of a first end portion and a second end portion. A first clip is adapted to be secured to a first support that is generally vertical. The first clip has a base and two flanges. When installed, the flanges are adapted to extend from the base in directions away from the first support. The first end portion of the drainage panel is held between the flanges of the first clip. The second clip is adapted to be secured to a second support that is generally vertical. The second clip also has a base and two flanges. The flanges are adapted to extend from the base in directions away from the second support when installed. The second end portion of the drainage panel is held between the flanges of the second clip. This drainage system may include the optional and preferred features of the previous embodiments.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to a drainage system. The drainage system is particularly useful for routing water that passes through the gaps in an outdoor deck surface. However, it should be recognized that the drainage system may be installed at any suitable location to route any appropriate liquid, semi-liquid, or solid.

Figure 1:
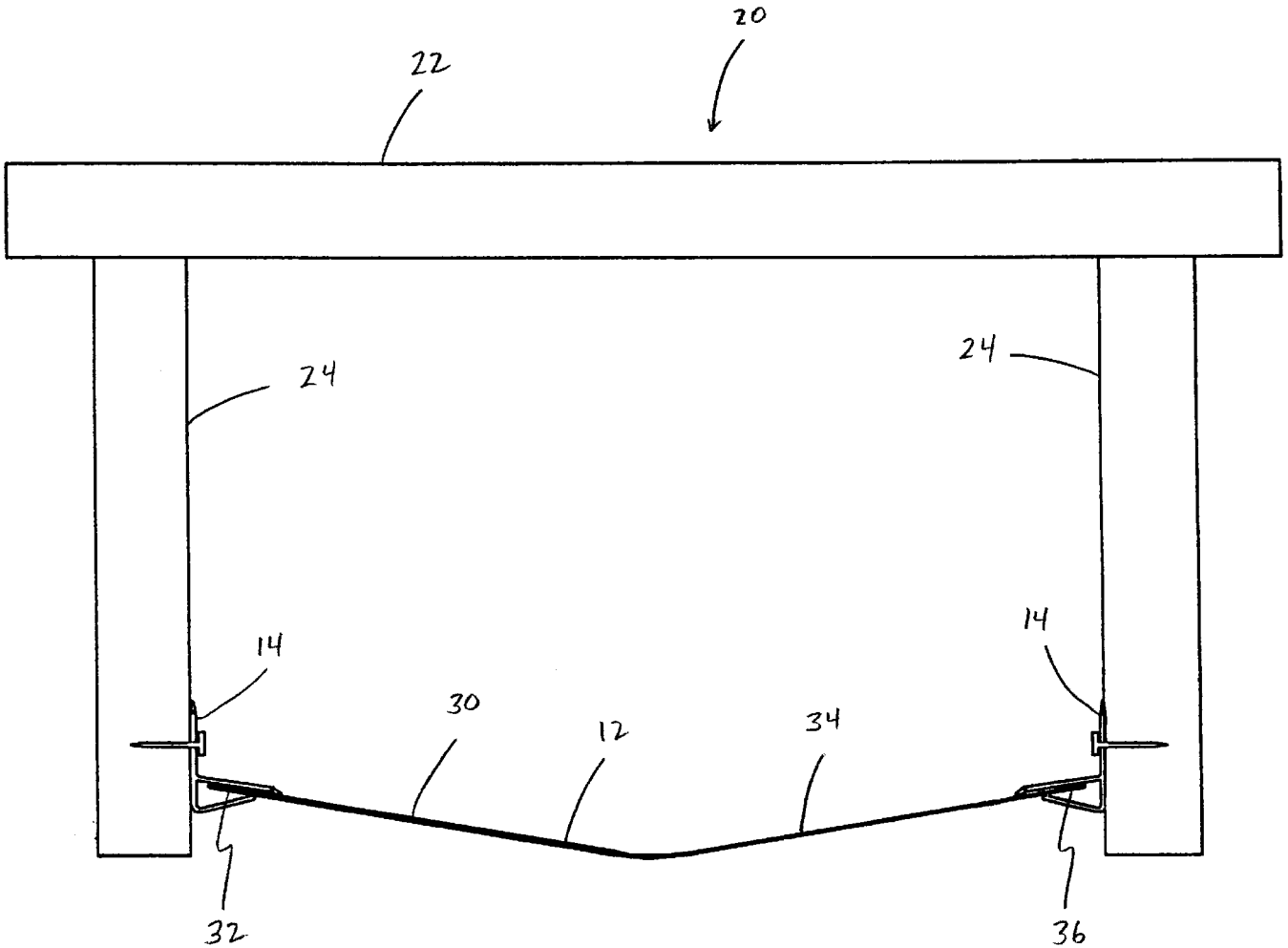
FIG. 1 is a side elevation view of an installation of a preferred embodiment of a drainage system of the present invention.

FIG. 1 shows a preferred embodiment of the drainage system 10 installed on a deck 20.

The deck 20 has a plurality of deck boards 22 that are mounted or otherwise supported by a plurality of deck supports or joists 24. The drainage system 10 is installed between deck joists 24. The drainage system 10 is comprised of a drainage panel 12 and clips 14. The clips 14 are connected to the deck joists 24, and the drainage panel 12 extends between the clips 14. As a result, the drainage system 10 receives water or other liquid or debris that passes through the gaps in the deck boards 22.

The drainage system 10 may be installed on an existing or new deck 20. The drainage system 10 preferably routes the water to a gutter or otherwise away from the area underneath the deck 20. Accordingly, the drainage system 10 is preferably installed at an angle relative to horizontal, and the drainage system 10 preferably extends a sufficient distance to receive substantially all of the water that passes through the gaps in the deck boards 22. For optimum results, it is recommended that the drainage system 10 be installed with a minimum 0.8-degree slope. Those skilled in the art should recognize that the optimum slope may vary according to the application and the matter being drained.

Those skilled in the art should also recognize that the dimensions of the drainage panel 12 and the clips 14 may vary according to the application and the matter being drained. The drainage panel 12 and the clips 14 may be made by any appropriate method (e.g., extrusion or molding) using any materials that are suitable for the application (e.g., plastic, metal, or wood). It is preferred that the drainage panel 12 and the clips 14 are made from a weather-resistant material. In particular, it is preferred that the drainage panel 12 and the clips 14 are made by the extrusion of a rigid polyvinyl chloride (PVC) compound. The use of rigid PVC or other suitable weather-resistant material preferably makes the drainage system 10 relatively maintenance free for the life of the deck.

Referring to FIG. 1, the drainage panel 12 is comprised of a side 30 and a side 34. Side 30 has an end portion 32, and side 34 has an end portion 36. It is preferred that side 30 and side 34 are each substantially straight. It is further preferred that the drainage panel 12 is generally V-shaped as shown in FIG. 1 such that the water flows away from the connections between the drainage panel 12 and the clips 14. However, those skilled in the art should recognize that the drainage panel may have any shape that enables it to be engaged, or otherwise held, by the clips. For example, the drainage panel may be flat, or it may have two or more sides. For another example, the drainage panel may be generally U-shaped, or it may have a shape in which its middle portion is higher than its end portions.

Figure 2:
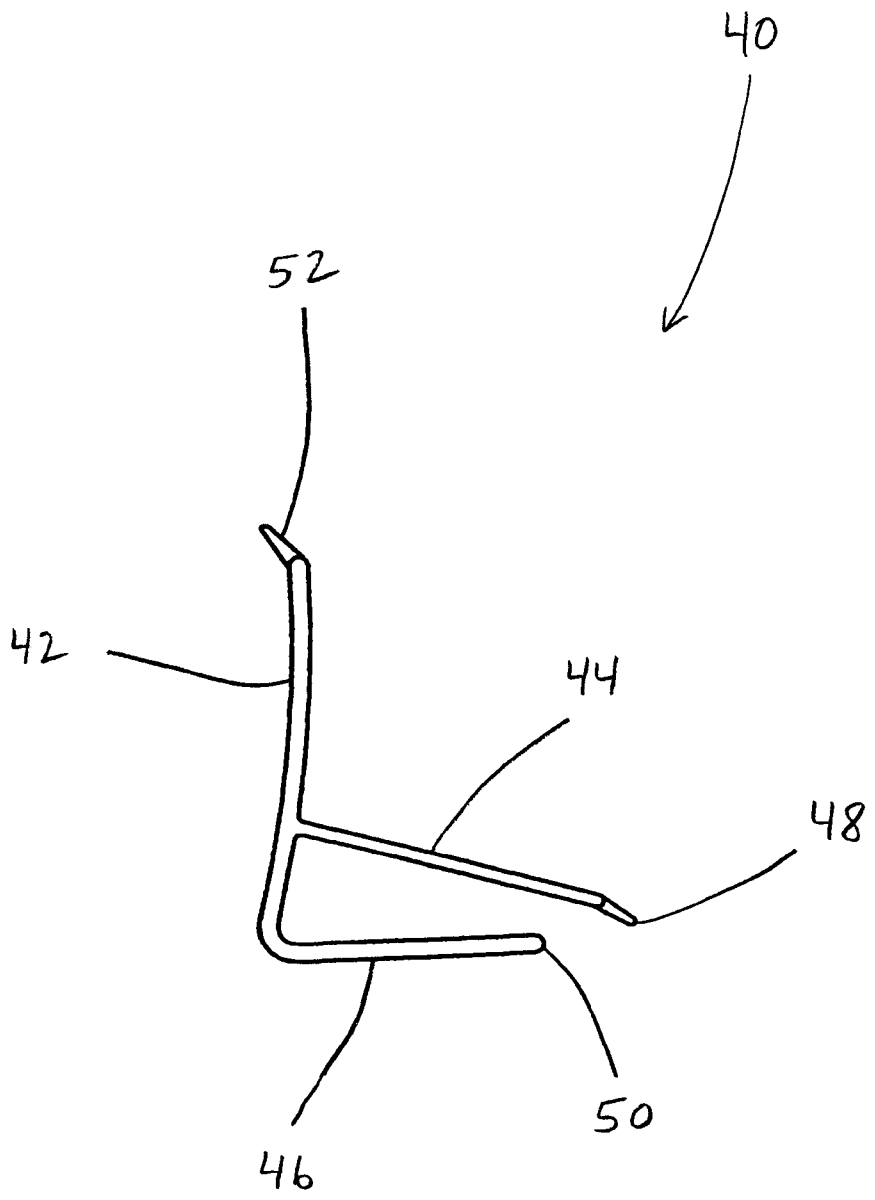
FIG. 2 is a side elevation view of a preferred embodiment of a clip for a drainage system of the present invention.

It is preferred that the clips that engage or hold the drainage panel are substantially identical. FIG. 2 shows an example of a clip 40. The clip 40 is comprised of a base 42, flange 44, and flange 46. Flange 44 has a tip 48, and flange 46 has a tip 50. In this example, the flange 44 is longer than the flange 46. Such an embodiment preferably makes it easier for a person on the ground to insert an end portion of a drainage panel between flange 44 and flange 46 which may be a substantial distance overhead. However, those skilled in the art should recognize that the lower flange may be the same length as, or longer than, the upper flange.

A clip may have any suitable shape for engaging or holding an end portion of a drainage panel. It is preferred that the clip is generally F-shaped as shown in FIG. 2. In the example of FIG. 2, both flange 44 and flange 46 are substantially straight, although tip 48 extends at an angle from the remainder of flange 44. Flange 44 and flange 46 converge toward each other to facilitate the engagement or holding of an end portion of a drainage panel. Nevertheless, those skilled in the art should recognize that the flanges may not converge but still engage or hold an end portion of a drainage panel. For example, the flanges may be parallel or even diverge.

Figure 3:
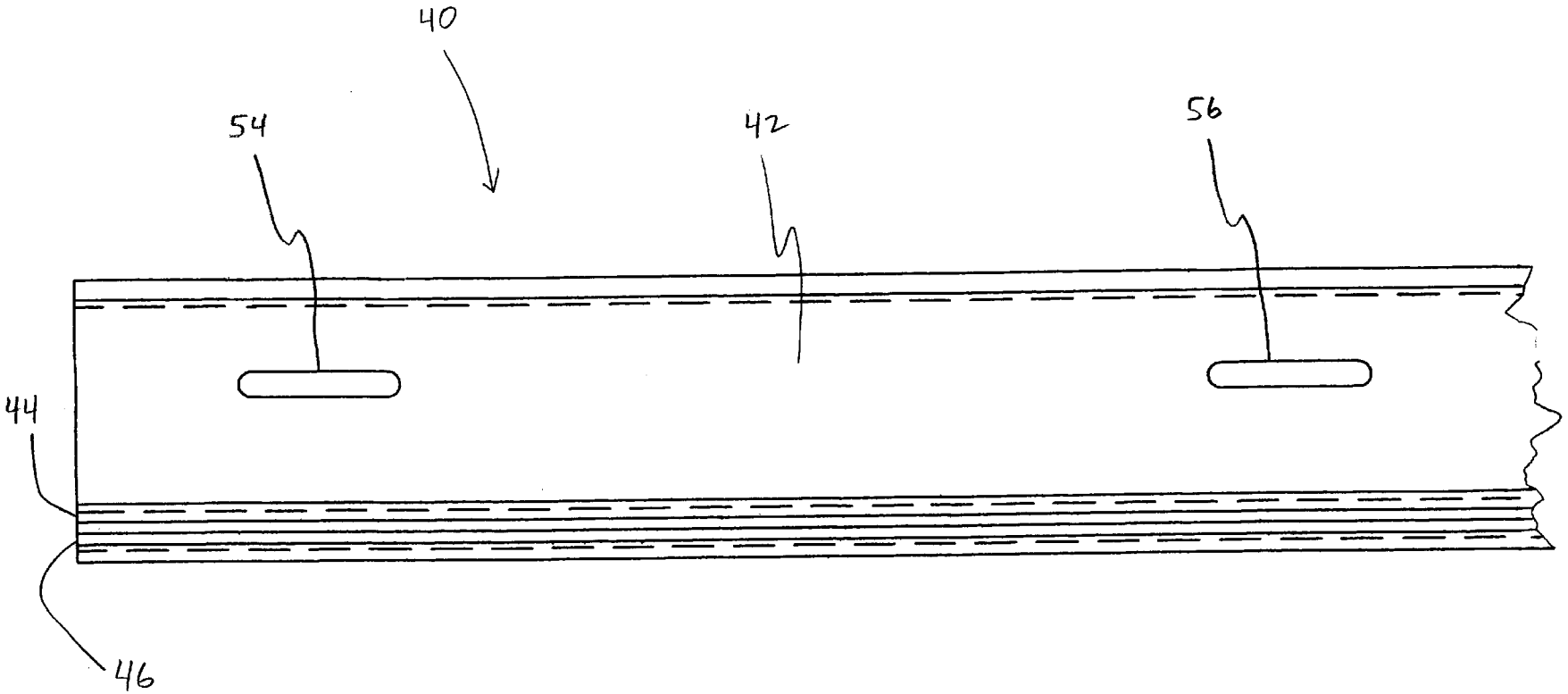
FIG. 3 is front elevation view of the clip of FIG. 2.

The clip 40 is preferably about the same length as the drainage panel. FIG. 3 shows the front of the clip 40. In this example, aperture 54 and aperture 56 extend through the base 42. As a result, the clip 40 may be secured to a support, e.g., a deck joist, by driving nails through aperture 54 and aperture 56 and into the support. However, it should be recognized that a clip may be secured to a support by any appropriate means including, but not limited to, adhesives, epoxies, tacks, staples, and screws. In addition, a clip may be secured to a support by extending its base over the top of the support or by clamping a portion of its base between the support and another structure, e.g., a deck board.

Figure 4:
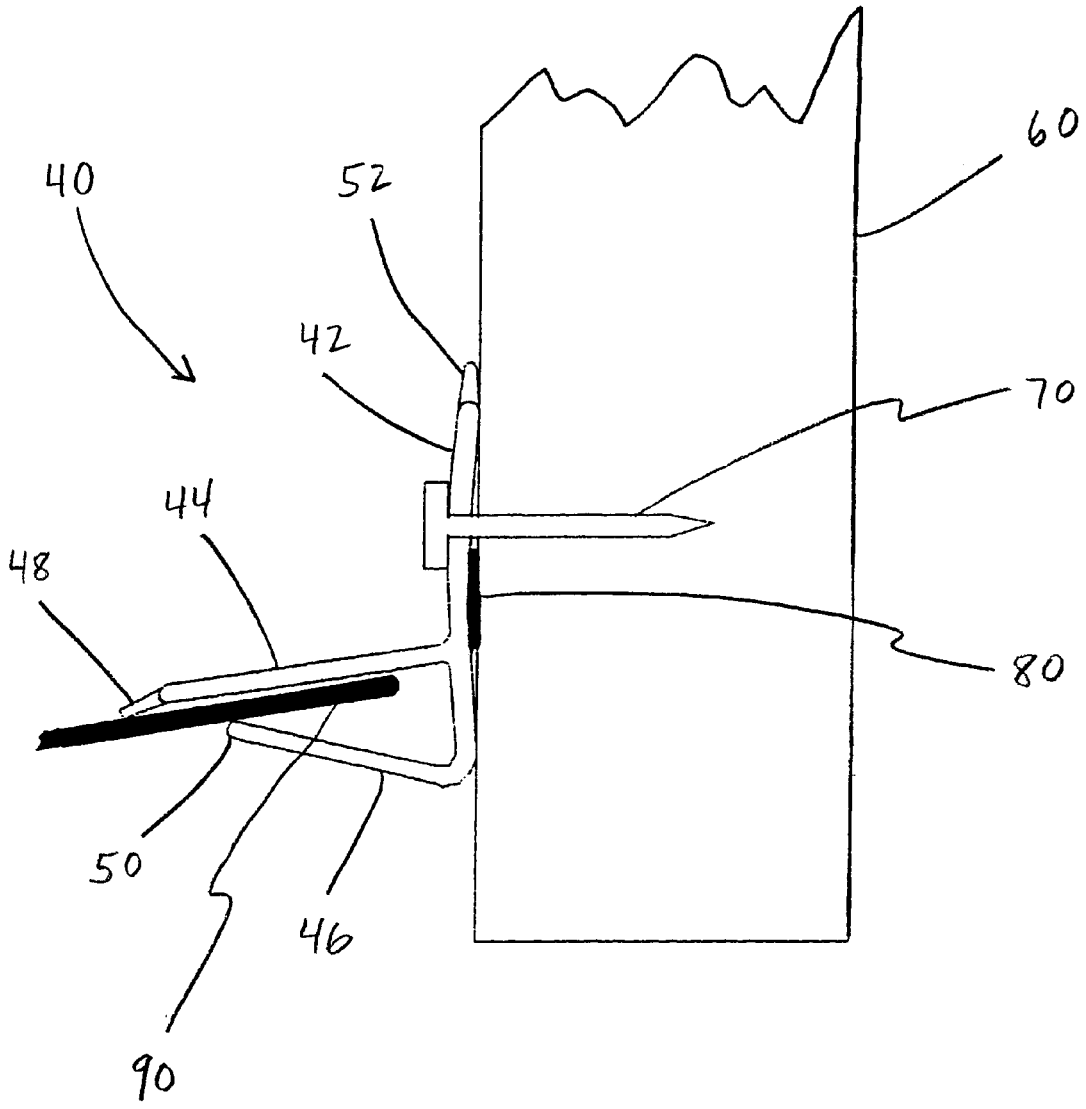
FIG. 4 is a partial side elevation view of an installation of another preferred embodiment of a drainage system of the present invention.

FIG. 4 shows the clip 40 secured to a support 60. In this example, the clip 40 is secured to the support 60 by at least one nail 70. As shown in FIG. 2, the base 42 preferably has a slight curvature and a tip 52 which extends at an angle from the remainder of the base 42. Such an embodiment preferably facilitates the formation of a substantially water-tight connection between the clip 40 and the support 60. If desired, a bead of caulk 80 or any other appropriate material may be placed on the back of the base 42 to improve the seal between the clip 40 and the support 60.

In FIG. 4, flange 44 and flange 46 converge as they extend away from the support 60. After the clip 40 is secured to the support 60, an end portion 90 of a drainage panel may be inserted or snapped into place between flange 44 and flange 46. As a result, flange 44 and flange 46 engage and hold the end portion 90. In particular, the end portion 90 is engaged and held only by tip 48 and tip 50 in this example. However, it should be recognized that the clips may engage or hold a drainage panel in any manner sufficient for the intended application. For example, an end portion of the drainage panel may be interlocked with one or both of the flanges of a clip.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A drainage system comprising:

a drainage panel comprised of a first end portion and a second end portion;

a first clip adapted to be secured to a first support, said first clip having a first base, a first flange, and a second flange, said first flange extending from said first base in an upward direction and said second flange extending from said first base in a downward direction such that said first flange and said second flange converge, said first flange and said second flange engaging said first end portion of said drainage panel; and a second clip adapted to be secured to a second support, said second clip having a second base, a third flange, and a fourth flange, said third flange extending from said second base in an upward direction and said fourth flange extending from said second base in a downward direction such that said third flange and said fourth flange converge, said third flange and said fourth flange engaging said second end portion of said drainage panel.

2. The drainage system of claim 1 wherein said drainage panel is generally V-shaped.

3. The drainage system of claim 1 wherein said drainage panel is generally U-shaped.

4. The drainage system of claim 1 wherein said first clip and said second clip are substantially identical.

5. The drainage system of claim 1 wherein:

said first flange is disposed substantially above said second flange, said first flange being longer than said second flange; and said third flange is disposed substantially above said fourth flange, said third flange being longer than said fourth flange.

6. The drainage system of claim 1 wherein each of said first flange, said second flange, said third flange, and said fourth flange are substantially straight.

7. The drainage system of claim 1 wherein:

said first clip is adapted to be secured to said first support by at least one nail; and said second clip is adapted to be secured to said second support by at least one nail.

8. The drainage system of claim 1 wherein said first clip and said second clip are each generally F-shaped.

9. A drainage system comprising:

a drainage panel comprised of a first end portion and a second end portion;

a first clip adapted to be secured to a first support, said first clip having a first base, a first flange, and a second flange, said first flange and said second flange extending from said first base, said first flange having a first tip, said second flange having a second tip, said first end portion of said drainage panel held only by said first tip and said second tip; and a second clip adapted to be secured to a second support, said second clip having a second base, a third flange, and a fourth flange, said third flange and said fourth flange extending from said second base, said third flange having a third tip, said fourth flange having a fourth tip, said second end portion of said drainage panel held only by said third tip and said fourth tip.

10. The drainage system of claim 9 wherein said drainage panel is generally V-shaped.

11. The drainage system of claim 9 wherein said drainage panel is generally U-shaped.

12. The drainage system of claim 9 wherein said first clip and said second clip are substantially identical.

13. The drainage system of claim 9 wherein each of said first flange, said second flange, said third flange, and said fourth flange are substantially straight.

14. The drainage system of claim 9 wherein:

said first flange is disposed substantially above said second flange, said first flange being longer than said second flange; and said third flange is disposed substantially above said fourth flange, said third flange being longer than said fourth flange.

15. The drainage system of claim 9 wherein:

said first flange and said second flange extend from said first base such that said first flange and said second flange converge; and said third flange and said fourth flange extend from said second base such that said third flange and said fourth flange converge.

16. The drainage system of claim 9 wherein:

said first clip is adapted to be secured to said first support by at least one nail; and said second clip is adapted to be secured to said second support by at least one nail.

17. The drainage system of claim 9 wherein said first clip and said second clip are each generally F-shaped.

18. A drainage system comprising:

a drainage panel comprised of a first end portion and a second end portion;

a first clip adapted to be secured to a first support that is generally vertical, said first clip having a first base, a first flange, and a second flange, said first flange and said second flange adapted to extend from said first base in opposing directions away from said first support when installed, said first end portion of said drainage panel held between said first flange and said second flange; and a second clip adapted to be secured to a second support that is generally vertical, said second clip having a second base, a third flange, and a fourth flange, said third flange and said fourth flange adapted to extend from said second base in opposing directions away from said second support when installed, said second end portion of said drainage panel held between said third flange and said fourth flange.

19. The drainage system of claim 18 wherein said drainage panel is generally V-shaped.

20. The drainage system of claim 18 wherein:

said first flange and said second flange extend from said first base such that said first flange and said second flange converge; and said third flange and said fourth flange extend from said second base such that said third flange and said fourth flange converge.

* * * * *